US005303954A

United States Patent [19]

Suda

[11] Patent Number: 5,303,954

[45] Date of Patent: Apr. 19, 1994

[54] ATTACHMENT TO A SKI STICK

[75] Inventor: Hitoshi Suda, Fuchu, Japan

[73] Assignee: Kokusai System Kabushiki Kaisha, Tokyo, Japan

[21] Appl. No.: 47,594

[22] Filed: Apr. 14, 1993

[30] Foreign Application Priority Data

Oct. 19, 1992 [JP] Japan ..... 4-78390

[51] Int. Cl.[5] ..... A63C 11/22

[52] U.S. Cl. ..... 280/819; 135/66

[58] Field of Search ..... 280/809, 816, 819, 821; 135/65, 66

[56] References Cited

U.S. PATENT DOCUMENTS

| | | | |
|---|---|---|---|
| 4,082,302 | 4/1978 | Albrect | 280/821 |
| 4,206,445 | 6/1980 | Steinhauer | 280/819 |
| 4,244,220 | 1/1981 | Henson et al. | 280/819 |
| 4,278,274 | 7/1981 | Ray | 280/821 |
| 4,731,766 | 3/1988 | Banges | 280/819 |
| 4,832,368 | 5/1989 | Steffanoff | 280/819 |
| 4,930,810 | 6/1990 | Addison, Jr. | 280/821 |
| 4,967,684 | 11/1990 | Vidovic et al. | 280/821 |
| 5,029,897 | 7/1991 | Borg | 280/821 |

*Primary Examiner*—Richard M. Camby
*Attorney, Agent, or Firm*—Jordan and Hamburg

[57] ABSTRACT

An attachment including a timepiece having a function of a stop watch is attached onto the top of a ski stick in order to allow a skier to learn the current time, elapsed time and other time information while skiing, thus more enjoying skiing. By incorporating a thermometer, a barometer, and/or a speed meter in the attachment, the safety of skiing can be heightened.

6 Claims, 7 Drawing Sheets

ATTACHMENT TO A SKI STICK

BACKGROUND OF THE INVENTION

1. Field of the Invention

This invention relates to an attachment to a ski stick, capable of more enhancing enjoyment of skiing and playing safe skiing.

2. Description of the Prior Art

Various skiing accessories have been so far to expand the pleasure of skiing all the more. Skiing can also be enjoyed visually by looking at showily designed ski suits which skiers wear. Though a beginner of skiing occasionally tends to ski in a senior ski course, he is in danger of colliding with another skier when a ski slope is crowded.

When doing a time trial race to find more delight in skiing, a ski player cannot easily look at his wrist watch and surely operate the switches of the wrist watch because he wears gloves. Even if the ski player has a stop watch hanging from his neck, it will be difficult for him to turn on and off the switch of the stop watch, and an accurate measurement of elapsed time in skiing cannot be taken because the ski player must operate the stop watch by himself, resulting in time lags in switching on the stop watch when making a start and switching off the stop watch when reaching the goal in skiing. Furthermore, the stop watch hanging from the neck of the ski player disadvantageously swings and hinders the ski player in skiing. Although the measurement of the elapsed time in skiing can be taken by depending on a timekeeper other than the ski player, it will be awkward that the ski player cannot independently measure the elapsed time by himself without anyone. Thus, the pleasure of the time trial race will be diminished.

The skier is apt to forget time during skiing, as a consequence of which he possibly fails to catch the last ski lift or ropeway at times, for example. If the skier sometimes attempts getting a look at his wrist watch in order for remedying such trouble, he finds difficulty in looking at the wrist watch owing to the ski suit which he wears. Similarly, the skier participating in cross-country skiing will suffer a disadvantage such that he cannot easily consult his wrist watch to learn the time every a certain fixed time while skiing.

In the meantime, there is no measure of effectively preventing skiers from colliding with each other on a ski slope, excepting arousing skiers' attention verbally. However, the way of verbally calling the skiers' attention is not sufficient to completely obviate the danger of collision. In alpine skiing, it is disadvantageous in that mountains frequently undergo an abrupt change in weather and the inclemency of the weather cannot be forecasted with ease.

OBJECT OF THE INVENTION

This invention is made to obviate troubles as described above and has an object to provide an attachment to a ski stick, which allows a skier to know time with ease in spite of a ski suit which the skier wears.

Another object of this invention is to provide a device capable of easily measuring time or other measuring information with accuracy without depending on a person other than the skier and more expanding the pleasure of skiing.

Still another object of this invention is to provide a device capable of realizing joyful and safe skiing.

SUMMARY OF THE INVENTION

To attain the objects described above according to this invention, there is provided an attachment to a ski stick, which comprises an adapter fixed onto the top of the ski stick, an instrument unit to be attached to the adapter, and engaging means for detachably fixing the instrument unit onto the adapter.

The instrument unit mentioned above may comprise a measuring device and a warning device. The measuring device includes a timepiece, a thermometer, a barometer, and a speed meter. The measuring device has a switch operating unit. The engaging means mentioned above is formed of a pair of coupling members which are detachably joined to each other.

The adapter may be formed independent of the ski stick or integrated with the ski stick. In the case of the adapter formed independent of the ski stick, a screw for fixing a grip and/or wrist strap onto the top of the ski stick may be used for securing the adapter onto the ski stick, thereby to decrease the number of the components of the ski stick. Otherwise, a suitable adhesive agent or other fixing means including another screw may be used therefor. The timepiece mentioned above may be a stop watch, or include a watch having functions of measuring, recording and indicating time, and giving an alarm and a warning device. The switch operating unit may be formed of push button switches or a flat panel switch unit of a pressure sensitive type. The warning device noted above may be formed of warning means capable of issuing a warning sound and/or giving forth warning light.

Since the adapter can be used for fixing the instrument unit including the measuring device and the warning device, there is no necessity for individually mounting the measuring device and the warning device on the ski stick, thus decreasing the number of the components.

According to this invention, since the timepiece and other instruments mounted in the attachment can be easily handled while holding the ski stick, it becomes possible to take measurement of time with ease and give various warning signals.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The other objects and features of the present invention will be hereinafter explained in detail with reference to the accompanying drawings, wherein.

DESCRIPTION OF THE PREFERRED EMBODIMENTS

The present invention will become more fully understood from the detailed description given hereinbelow and the accompanying drawings which are given by way of illustration only, and thus are not limitative of the present invention.

Figure 1:
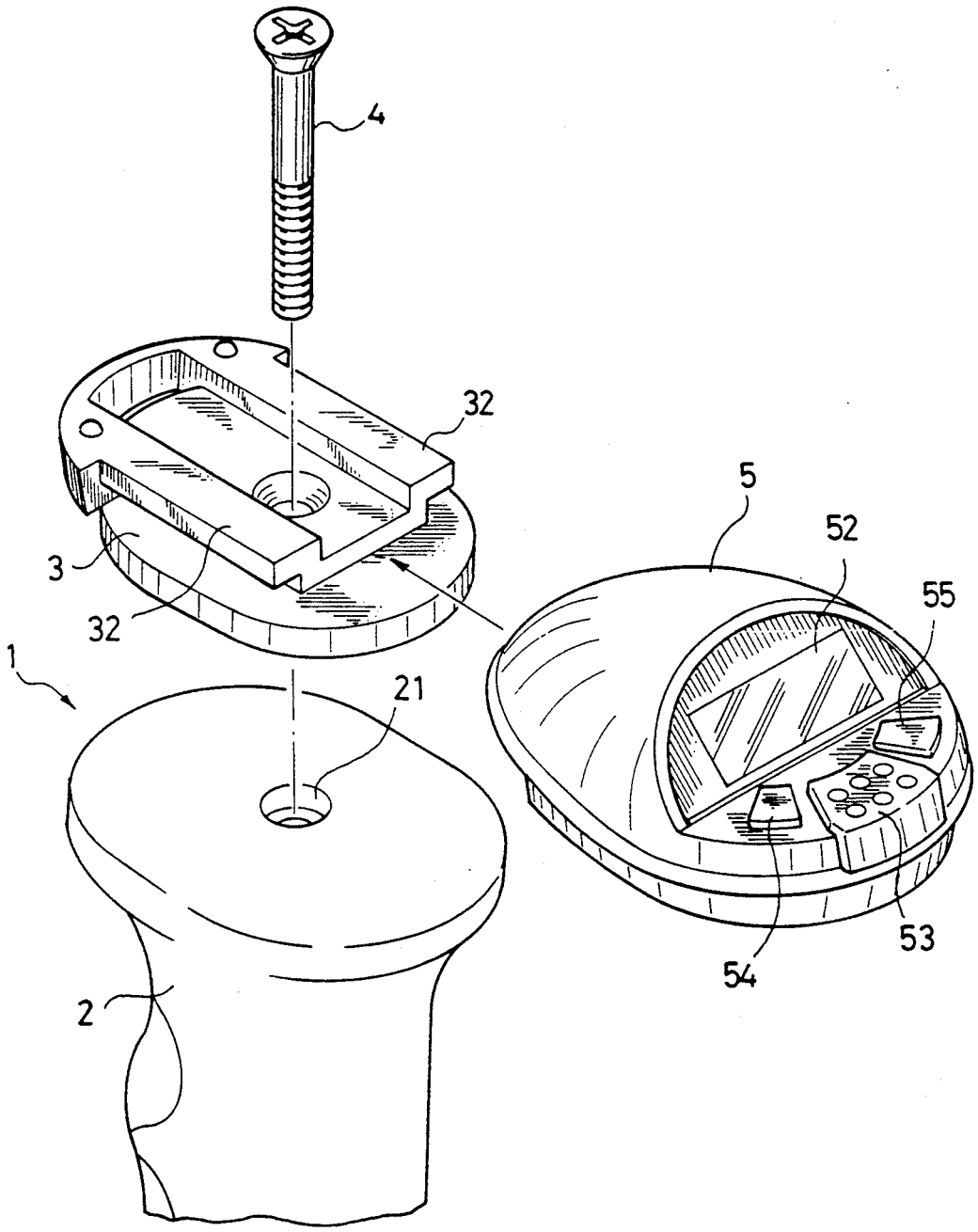
FIG. 1 is an exploded perspective view showing one embodiment of an attachment according to this invention, in use.

Referring to FIG. 1, an adapter 3 is detachably fixed onto the top of a grip 2 of a ski stick 1 by a screw 4 which is generally used for fixing the grip 2 to the shaft of the ski stick.

Figure 2:
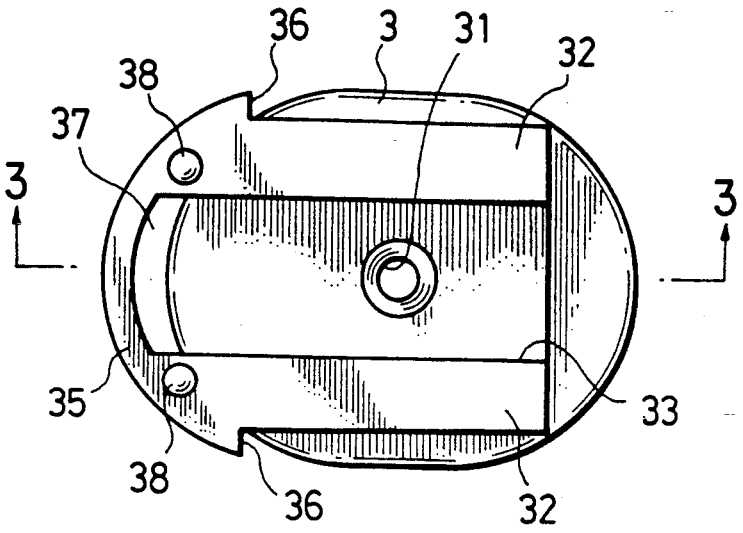
FIG. 2 is a plan view showing an adapter used in the device of this invention.
Figure 3:
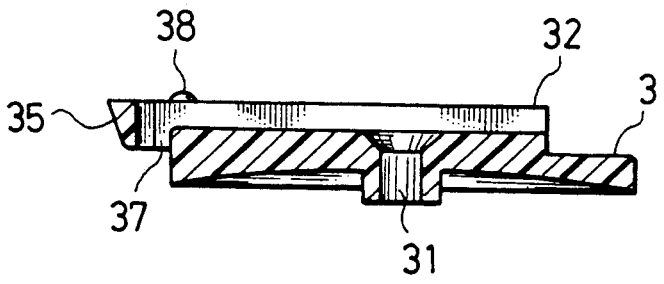
FIG. 3 is a cross sectional view taken on line 3—3 of FIG. 2.
Figure 4:
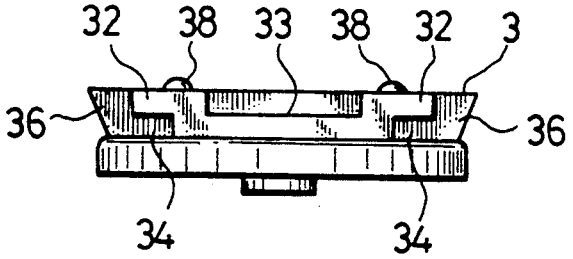
FIG. 4 is a side view of the adapter.
Figure 5:
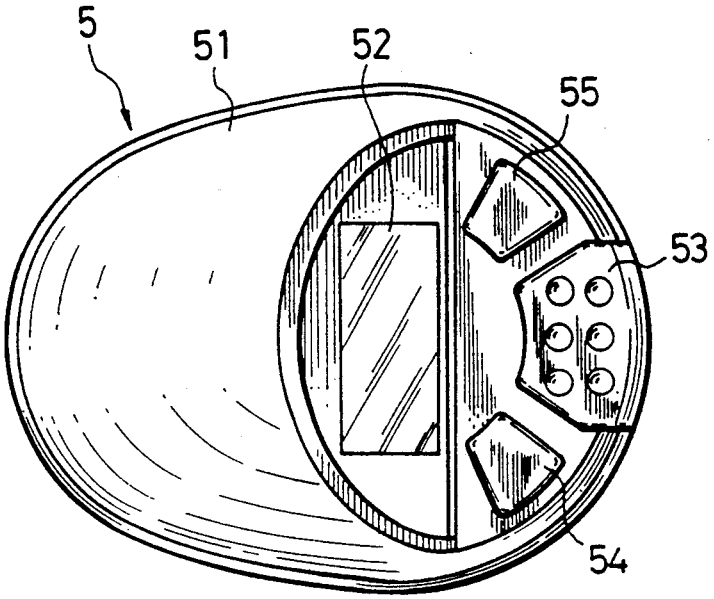
FIG. 5 is a plan view showing a timepiece used in the attachment of this invention.

The adapter 3 is formed of a plastic plate in an elliptical shape conforming to the shape in plan of the top of the grip 2 as shown in FIG. 2 through FIG. 4. The adapter 3 is provided in the substantially center thereof with a hole 31 for a screw 4, so as to be fixed on the top of the grip by thrusting the screw 4 into a hole 21 bored in the grip 2 through the hole 31 in the adapter 3. Thus, the screw 4 secures not only the grip 2 but also a wrist strap 22 (FIG. 10) to the ski stick.

The adapter 3 is provided on its upper surface with a pair of slide rails 32 forming one of coupling members constituting the engaging means. The slide rails 32 extend in parallel in the longitudinal direction of the adapter 3 so as to define a groove 33 therebetween, respectively. Each slide rail 32 is generally shaped in section in the letter of L, forming a space 34 thereunder. The slide rails 32 are in connection with each other through a connection member 35 at their left sides in FIG. 2. The connection member 35 has stoppers 36 and an opening 37 connecting with the groove 33. Further, the adapter 3 has a pair of positioning protrusions 38 on the upper surface of the left side thereof in FIG. 2.

Figure 6:
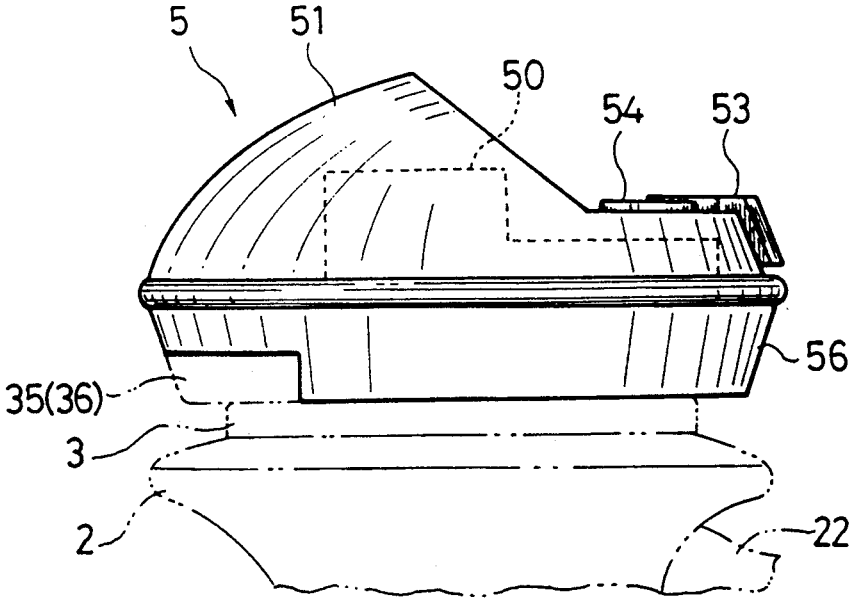
FIG. 6 is a front view of the timepiece.
Figure 7:
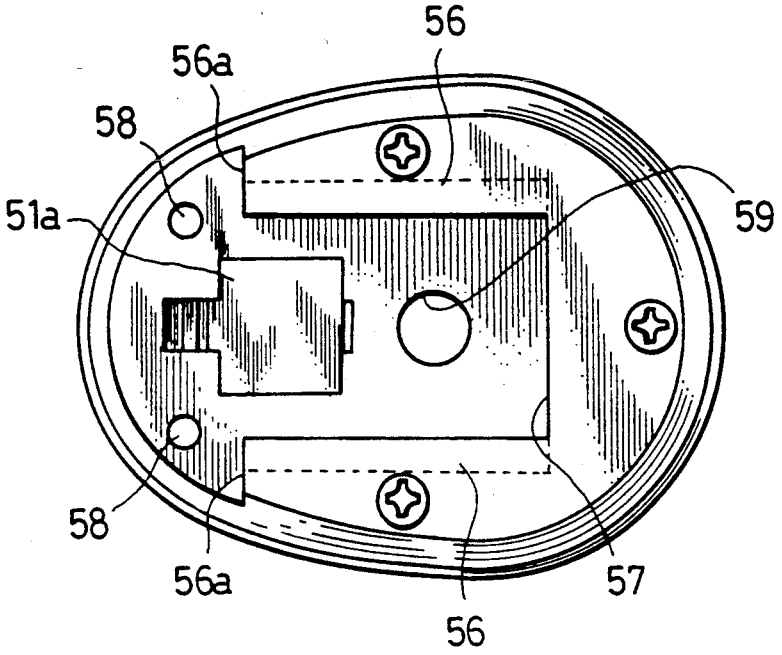
FIG. 7 is a bottom view of the timepiece.
Figure 8:
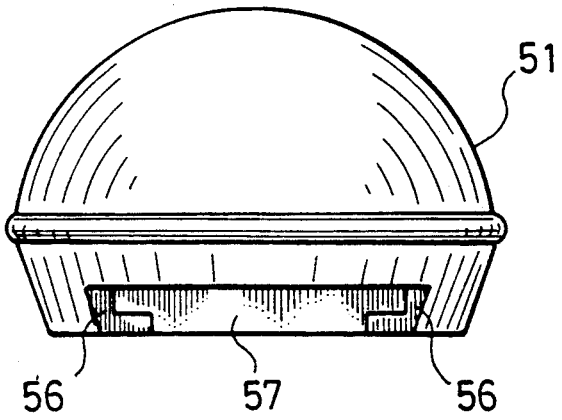
FIG. 8 is a side view showing the bottom of the timepiece.

On the upper surface of the adapter 3, an instrument unit including a timepiece 5 is mounted. The timepiece 5 shown in FIGS. 5 to 8 has an time operating unit 60 having the functions of a stop watch, a timer and an alarm. The timepiece 5 is contained in a watch case 51 whose front portion is defined by a substantially spherical surface for lessening the resistance of wind. The watch case 51 is identical with the adapter 3 in plane shape. The upper central portion of the watch case 51 of the timepiece is inclined downward toward the right in FIG. 6, on which a time indicating unit 52 is disposed so as to indicate the current time and other time information in digital representation. On the rear part of the upper surface of the watch case 51, there is disposed a switch operating unit having a setting switch button 53 for switching on and off the timepiece, a mode selecting switch button 54, and a reset switch button 55. A skier can readily operate these switch buttons with the thumb of his hand while holding the grip of the ski stick.

On the lower surface of the watch case 51, there are formed a pair of slide retainers 56 serving as a counterpart coupling member which constitutes the engaging means in conjunction with the aforementioned slide rails 32.

The slide retainers 56 extending in the longitudinal direction are disposed one on either side of the groove 57 formed in the central portion of the lower surface of the case 51. The slide retainers 56 are shaped in the letter of L in section so as to be movably fitted into the slide rails 32 of the adapter 3. Since the ends 56*a* of the slide retainers 56 collide with the stoppers 36, the slide retainers 56 are prevented from moving forward beyond the stoppers. In addition, in the lower surface of the case 51, positioning dents 58 are formed so as to receive the positioning protrusions 38 on the upper surface of the adapter 3. In the groove 57 of the case 51, a sounding hole 59 is bored for expelling outside a warning sound therethrough. Reference numeral 51*a* denotes a lid for a battery.

Figure 9:
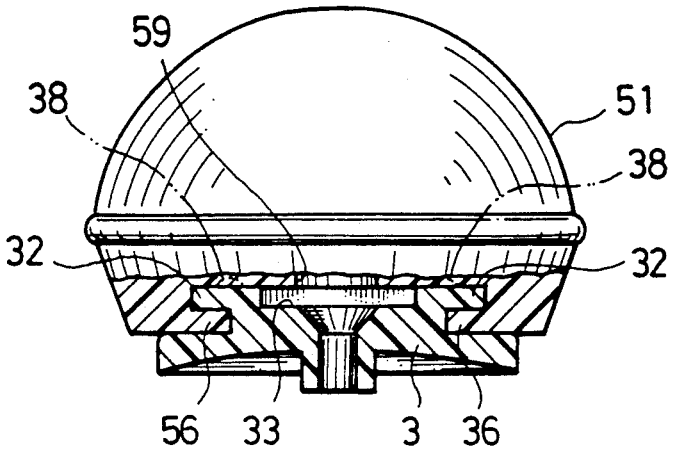
FIG. 9 is a sectional side view showing an engaging means for uniting the adapter and a case of the timepiece.

The manner of engaging the adapter 3 with the watch case 51 will be explained hereinafter with reference to FIG. 9 and FIG. 10.

Figure 10:
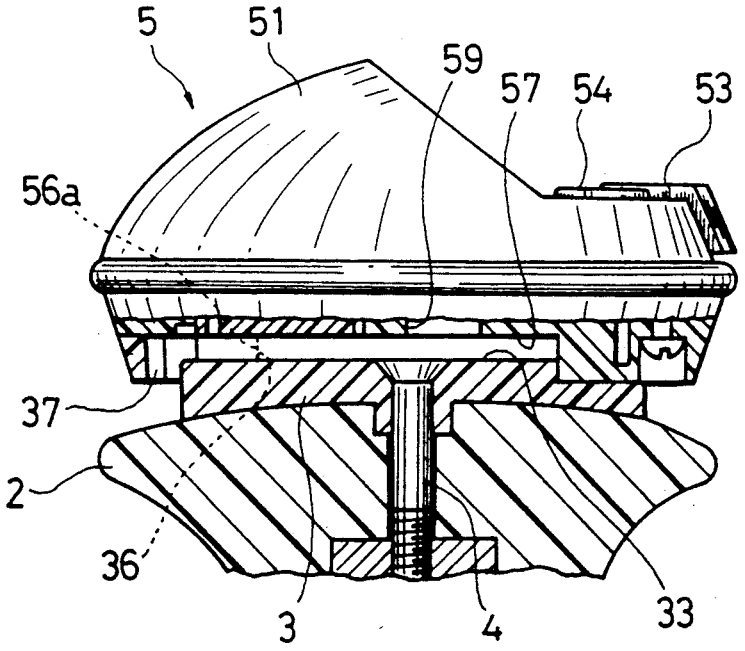
FIG. 10 is a sectional front view in part showing the engaging means.

First of all, the slide retainers 56 of the watch case 51 are inserted into the slide rails 32 of the adapter 5 from the right side in FIG. 10 until the ends 56*a* of the retainers 56 collide with the stoppers 36. At that time, since the positioning protrusions 38 of the adapter 3 are fitted into the positioning dents 58, the engagement of the watch case 51 and the adapter 3 are securely retained in position. In this engaged state of the watch case 51 and the adapter 3, the sounding hole 59 agrees with the opening 37 across the grooves 33 and 57 so as to permit the warning sound to pass outside the case through the opening 37.

One example of the manner of attaching the timepiece 5 to the ski stick 1 will be described. The adapter 3 is beforehand fixed onto the top of the grip 2 of the ski stick with the screw 4. Then, the slide retainers 56 of the watch case 51 for the timepiece 5 are inserted along the slide rails 32 of the adapter 3 in the direction indicated by the arrow in FIG. 1 until the ends 56*a* of the slide retainers collide with the stoppers 36. When the ends 56*a* collide with the stoppers 36, the positioning protrusions 38 fall into the positioning dents 58, thus securing the timepiece onto the grip 2 of the ski stick in position.

In a case of doing a time trial race on a ski slope, the mode selecting switch button 54 is operated in advance to select the mode of a stop watch. Then, the skier stands on the start line and pushes the setting switch button with his thumb while holding the grip of the ski stick, to start taking time count at the time of starting skiing. When the skier reaches the goal, the setting switch button is again pushed to stop time counting. Consequently, the elapsed time is measured and indicated on the time indicating unit 52.

Thus, a skiing technique may be possibly improved and, enjoyment of skiing can be more enhanced by use of the attachment according to this invention.

Figure 11:
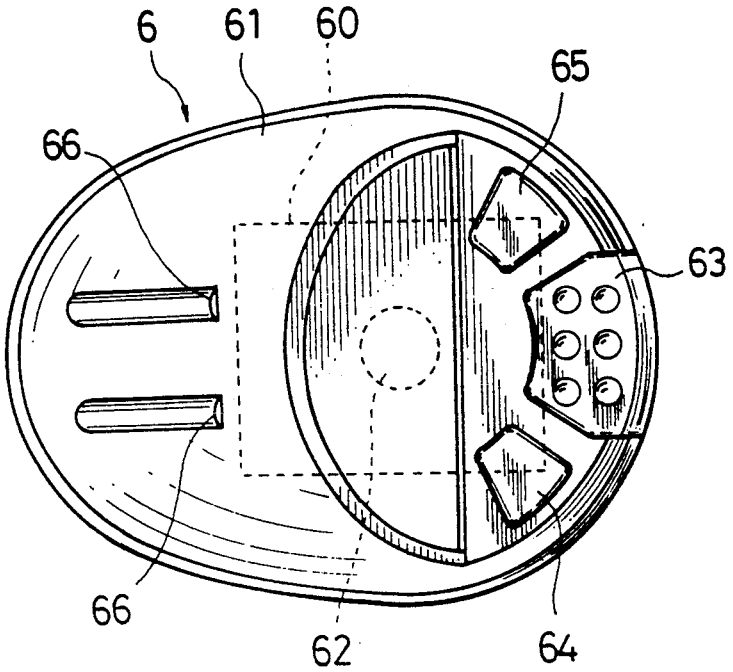
FIG. 11 is a plan view showing a warning device.

In FIG. 11, another embodiment incorporating an warning device 6 in the instrument unit is shown. In this embodiment, a case 61 accommodating the time operating unit 60 is substantially equal in shape to the aforenoted watch case 51, and a sounding hole 62 is formed in the case at the same position as the aforementioned sounding hole 59. The case 61 is provided on its rear portion with three switch buttons 63, 64 and 65. Each time these switch buttons are pushed, a warning sound is issued, and at the same time, a warning light is emitted from light source means 66 such as LED disposed on the front part of the case 61.

As a matter of example, the warning device may work so as to issue a short electrical sound when pushing the switch button 63, a sequence of electrical sound pulses when pushing the center switch button 64, and a buzzer sound when pushing the switch button 65. Thus, by selectively pushing one of the switch buttons 63–65, the corresponding warning sound is expelled from the sounding hole 62 with emitting light.

The structure of the engaging means for uniting the warning device 6 and the adapter 3 is substantially equivalent to that for the aforementioned timepiece 5.

The use of the warning device 6 attached to the ski stick will be described. This contrivance serves to ensure the safety of skiing. The warning device 6 can be attached to the grip of ski stick in the same manner of attaching the timepiece 51 to the grip as mentioned above.

In a case when a skier is in danger of collision with another skiers in skiing, one of the switch buttons 63–65 may be pushed to serve a warning by the warning sound and the on-and-off flashing light emitted from the light source means 66.

Otherwise, the device of this invention may be used in such a manner that the timepiece 5 is attached to one of a pair of ski sticks, and the warning device 6 is attached to the other ski stick.

Figure 12:
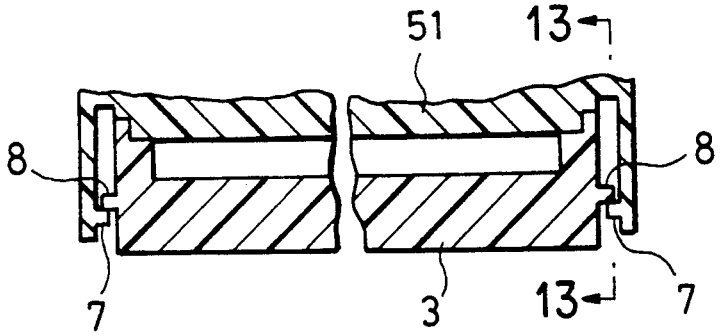
FIG. 12 is an enlarged sectional view showing another embodiment of the engaging means.
Figure 13:
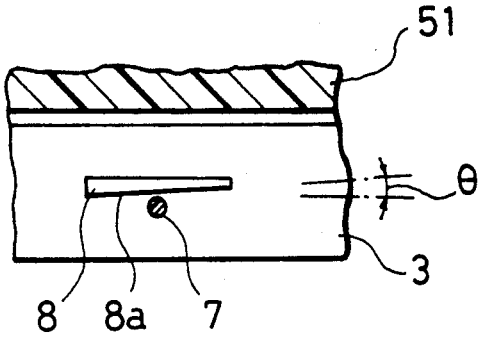
FIG. 13 is a cross sectional view taken on line 13—13 of FIG. 12.

By the engaging means constituted by the aforenoted slide rails and slide retainers, the case 51 or 61 can be securely fixed onto the ski stick without coming out of place even when handling the ski stick violently. However, the engaging means is not specifically limited to the structure described above and may be constructed by, for instance, a bayonet type locking mechanism as shown in FIG. 12 and FIG. 13. In the embodiment illustrated, the case 51 is provided on the lower surface thereof with two pins 7, and the adapter 3 is provided on the outer surface thereof with protrusions 8. The lower surface of the protrusion 8 is inclined at a prescribed angle $\alpha$ in the circumferential direction, so that the case 51 is firmly united with the adapter 3 by turning the case 51 so as to move the pins 7 along the lower surfaces of the protrusions 8.

Figure 14:
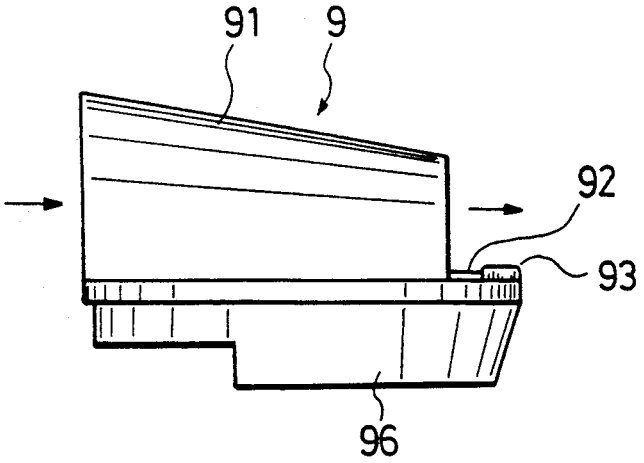
FIG. 14 is a front view of a speed meter used in the device of this invention.

The instrument unit may include a speed meter 9 as shown in FIG. 14. The speed meter 9 has an air duct 91 for permitting air to pass therethrough so as to cause a pressure anemometer to receive the air. Thus, the speed at which the skier skis can be measured by calculating the pressure of the air passing through the air duct 91 and visually indicated on a display 92. In the drawing, reference numeral 93 denotes a switch operating unit, and numeral 96 denotes slide engaging means.

If skiing in a senior ski course, for example, it is desirable to use a pair of ski sticks 1, one having the timepiece 5 and the warning device 6, and the other having the speed meter 9 with the display 92 capable of indicating the maximum descent speed and so on. The skier will take pleasure in looking at the speed displayed while skiing.

The instrument unit may include either or a combination of a thermometer and a barometer, or incorporate these meters together with the timepiece as noted above. By use of the ski stick with the instrument unit having the barometer, weather can be forecasted with ease, and thus, even alpine skiing can be done in safety.

According to this invention proposing an attachment to a ski stick as described above, since the instrument unit including the measuring device and the warning device can readily be attached onto the ski stick, a skier can easily learn the current time while skiing and enjoy safe skiing. Furthermore, it is advantageous to obtain various information including elapsed time in skiing. By incorporating the measuring device in the instrument unit of the attachment according to this invention, the skier can operate by himself the switch operating unit of the measuring device while holding the ski stick to measure time without depending on a timekeeper or another person, and an accurate measurement of the elapsed time in skiing can be taken with ease. With the instrument unit incorporating the timepiece, the skier can alone enjoy a time trial race. By fixing the adapter onto the ski stick by use of a screw for originally securing the grip onto the ski stick, no specific mounting means for attaching the adapter to the ski stick is necessary, and thus, the adapter can be readily retained onto the common ski stick. By using the warning device in the instrument unit, collision between skiers can be effectively prevented and more safe skiing can be enjoyed. Furthermore, by incorporating a measuring such as a thermometer and a barometer in the instrument unit, alpine skiing and so on can be enjoyed in safety, and by using a speed meter, the speed at which the skier skis can be learnt instantly. Thus, according to the attachment of the invention, the pleasure of skiing can be more expanded.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An attachment to a ski stick having a top, comprising an adapter fixed onto the top of said ski stick, an instrument unit to be attached to said adapter and having a case, and engaging means for detachably fixing said instrument unit onto said adapter, said instrument unit including at least one of a measuring device and a warning device, and a switch operating unit, said engaging means being formed of coupling members each disposed on said adapter and said case of said instrument unit, said coupling members of said adapter and said instrument unit being detachably engaged with each other, said coupling member of said adapter being a pair of slide rails, and said coupling member of said instrument unit being a pair of slide retainers fitted to said slide rails.

2. An attachment according to claim 1, wherein said measuring device includes at least one of a timepiece, a thermometer, a barometer, and a speed meter.

3. An attachment according to claim 1, wherein said measuring device includes a timepiece having a function of a stop watch.

4. An attachment according to claim 1, wherein said warning device has a function of issuing a warning sound.

5. An attachment according to claim 1, wherein said warning device has a function of emitting a warning light.

6. An attachment to a ski stick having a top, comprising an adapter fixed onto the top of said ski stick, an instrument unit to be attached to said adapter and having a case, and engaging means for detachably fixing said instrument unit onto said adapter, said instrument unit including at least one of a measuring device and a warning device, and a switch operating unit, said engaging means being formed of coupling members each disposed on said adapter and said case of said instrument unit, said coupling members of said adapter and said instrument unit being detachably engaged with each other, said adapter being detachably secured on the top of said ski stick by means of a screw, said coupling member of said adapter being a pair of slide rails, and said coupling member of said instrument unit being a pair of slide retainers fitted to said slide rails.

* * * * *